US008505458B1

(12) United States Patent
Cannon

(10) Patent No.: US 8,505,458 B1
(45) Date of Patent: Aug. 13, 2013

(54) VENTING CAP SYSTEM

(75) Inventor: Thomas C. Cannon, La Plata, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/374,993

(22) Filed: Jan. 27, 2012

(51) Int. Cl.
*F42B 12/00* (2006.01)

(52) U.S. Cl.
USPC ..... 102/481

(58) Field of Classification Search
USPC ..... 220/202, 4.07, 23.83, 23.86, 23.87, 220/23.89, 288, 303; 102/481; 206/3
See application file for complete search history.

(56) References Cited

U.S. PATENT DOCUMENTS 5,035,181 A 7/1991 Jacks et al.
5,036,658 A 8/1991 Tate
5,038,686 A * 8/1991 Zulkoski et al. ..... 102/481
5,044,514 A * 9/1991 Portat et al. ..... 220/23.87
5,207,341 A * 5/1993 Yeager ..... 220/288
5,786,544 A * 7/1998 Gill et al. ..... 102/481
6,363,855 B1 4/2002 Kim et al.
7,025,000 B1 4/2006 Wong et al.
7,213,622 B2 * 5/2007 Sakraschinsky et al. ..... 220/303
7,331,292 B1 2/2008 Kim et al.
2010/0024675 A1 * 2/2010 Cotet et al. ..... 102/481

* cited by examiner

*Primary Examiner* — Andrew Perreault
(74) *Attorney, Agent, or Firm* — Fredric J. Zimmerman

(57) ABSTRACT

A venting cap system includes a first open-ended sleeve and a second open-ended sleeve. The first open-ended sleeve is made from a first material that melts at a selected temperature. The first open-ended sleeve has an internal region commencing at a first end and an externally-threaded region commencing at a second end. The second open-ended sleeve is made from a second material that does not melt at the selected temperature. The second open-ended sleeve is coaxially fitted in the first open-ended sleeve. The second open-ended sleeve includes a first end that is flush with the first end of the first open-ended sleeve. The second open-ended sleeve partially overlaps part of the externally-threaded region. The coefficients of linear expansion of the first material and the second material are about equal.

24 Claims, 1 Drawing Sheet

VENTING CAP SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to safety systems for warheads or rockets, and more particularly to a mechanically-strong venting cap system that prevents a cook-off explosion in warheads or rockets.

BACKGROUND OF THE INVENTION

The term "cook-off" as it relates to military ordnance refers to the unwanted exploding of ordnance when subjected to high temperatures caused by fire or other sources of heat. A well-known approach to mitigating cook-off effects involves opening or "venting" both ends of the ordnance to prevent the ordnance from affecting, or from being affected by, adjacent explosive components. A particularly hazardous explosive component adjacent to a warhead is the warhead's detonating fuze. Accordingly, it is highly desirable to separate a fuze from its warhead when ambient temperatures approach those capable of starting a cook-off event.

One type of well-known cook-off venting system places a meltable (plastic) adapter between an end of a warhead and a warhead's fuze. As ambient temperatures approach those temperatures associated with a cook-off event, the adapter melts thereby allowing the fuze to fall away from the warhead while simultaneously venting the warhead. Unfortunately, plastic adapters are not very strong and are subject to cracking and breaking under impact loads, e.g., the ordnance is dropped during handling.

SUMMARY OF THE INVENTION

Accordingly, it is an object of the present invention to provide a venting cap system for a warhead.

Another object of the present invention is to provide a venting cap system for a warhead that supports the warhead's fuze, and provides for the release of the fuze and venting of the warhead in the presence of temperatures associated with a cook-off event.

Still another object of the present invention is to provide a venting cap system that is mechanically strong enough to withstand handling conditions.

Other objects and advantages of the present invention will become more obvious hereinafter in the specification and drawings.

In accordance with the present invention, a venting cap system includes a first open-ended sleeve and a second open-ended sleeve. The first open-ended sleeve is made from a first material that melts at a selected temperature. The first open-ended sleeve has an internal region commencing at a first end thereof defining a diameter $D_S$. The first open-ended sleeve has an externally-threaded region commencing at a second end thereof with the externally-threaded region defining a minor diameter $D_T$. The second open-ended sleeve is made from a second material that does not melt at the selected temperature. The second open-ended sleeve is coaxially fitted in the first open-ended sleeve. The second open-ended sleeve has a first end that is flush with the first end of the first open-ended sleeve. The second open-ended sleeve has a portion that axially overlaps at least part of the externally-threaded region of the first open-ended sleeve by an amount L that satisfies the relationship $L<(D_T^2-D_S^2)^{1/2}$. The coefficients of linear expansion of the first material and the second material are approximately equal.

BRIEF DESCRIPTION OF THE DRAWINGS

Other objects, features and advantages of the present invention will become apparent upon reference to the following description of the exemplary embodiments and to the drawings, where corresponding reference characters indicate corresponding parts throughout the several views of the drawings and wherein.

DETAILED DESCRIPTION OF THE INVENTION

Figure 1:
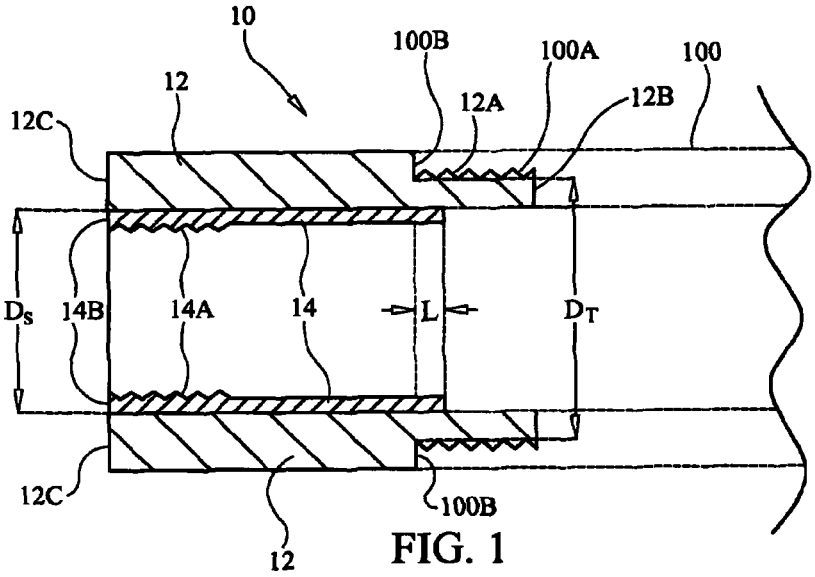
FIG. 1 is a cross-sectional view of a venting cap system in accordance with an embodiment of the present invention.

Referring now to the drawings and more particularly to FIG. 1, a venting cap system in accordance with an embodiment of the present invention is shown and is referenced generally by numeral 10. Venting cap system 10 is illustrated as it would be when coupled to an end of a warhead 100, the particular size and shape of which are not limitations of the present invention. Further, it is to be understood that warhead 100 is not part of the present invention and is, therefore, illustrated using dashed lines.

Venting cap system 10 is a two-piece system that is essentially two coaxial sleeves, an outer sleeve 12 and an inner sleeve 14. Outer sleeve 12 is an open-ended sleeve (e.g., substantially cylindrical in the illustrated embodiment) made from a material that will melt at a temperature associated with the onset of a cook-off event for warhead 100. One end of outer sleeve 12 is configured to be coupled to the illustrated end of warhead 100. For example, outer sleeve 12 may be externally-threaded at 12A near one end 12B to couple, threadably, to an internally-threaded region 100A of warhead 100. The minor diameter of externally-threaded region 12A is designated $D_T$. The opposing end 12C of outer sleeve 12 has an internal diameter designated $D_S$.

The material used for outer sleeve 12 may be a variety of thermoplastic materials to include, but not limited to, polycarbonate, compositions of polycarbonate and glass, nylon, and tetrafluoroethylene. Suitable compositions of polycarbonate and glass are disclosed in U.S. Pat. No. 7,331,292, the contents of which are hereby incorporated by reference.

Inner sleeve 14 is an open-ended sleeve (e.g., cylindrical in the illustrated embodiment) made from a material that will not melt at the temperature(s) associated with the onset of a cook-off event for warhead 100. Further, inner sleeve 14 is made from a material that enhances the mechanical strength of venting cap system 10. For example, inner sleeve 14 may be made from metal, the choice of which is predicated on the material used for outer sleeve 12 as will be explained further below. Inner sleeve 14 extends coaxially into and overlaps some or all of externally-threaded region 12A for a distance L. For purpose of the present invention, L must be less than $(D_T^2-D_S^2)^{1/2}$. In this way, when outer sleeve 12 melts away, inner sleeve 14 can freely fall away (i.e., pivot down) from the illustrated end 100B of warhead 100 that forms the pivot point for inner sleeve 14. This relationship is important because the warhead's fuze (not shown in FIG. 1) is coupled to inner sleeve 14. By way of example, an internal region of inner sleeve 14 may be threaded at 14A near outboard end 14B of inner sleeve 14 to accommodate coupling of a fuze thereto. To maximize the mechanical strength of venting cap system 10, inner sleeve 14 is sized such that outboard end 14B is flush with end 12C of outer sleeve 12, and such that the maximum value for L is used that satisfies the above-noted relationship.

As mentioned above, inner sleeve 14 may be a metal that is selected and predicated on the choice of material for outer sleeve 12. More specifically, to minimize the risks of debonding (i.e., outer sleeve 12 is generally molded about inner sleeve 14) at the inner faces of outer sleeve 12 and the outer faces of inner sleeve 14, the materials for both sleeves should be closely matched in terms of their coefficients of linear expansion. For example, if glass-filled polycarbonate (with a coefficient of linear expansion of $12.0\times10^{-6}$ in/in ° F.) is used for outer shell 12, aluminum (with a coefficient of linear expansion of $12.3\times10^{-6}$ in/in ° F.) is a good choice of material for inner sleeve 14. Additionally, some or all of the external radial surfaces of inner sleeve 14 may be knurled (e.g., small crosshatched score lines) to enhance the bonding grip between outer sleeve 12 and inner sleeve 14. Note that inner sleeve 14 is not generally threaded into outer sleeve 12 as the threads could introduce unwanted stress concentrations.

Figure 2:
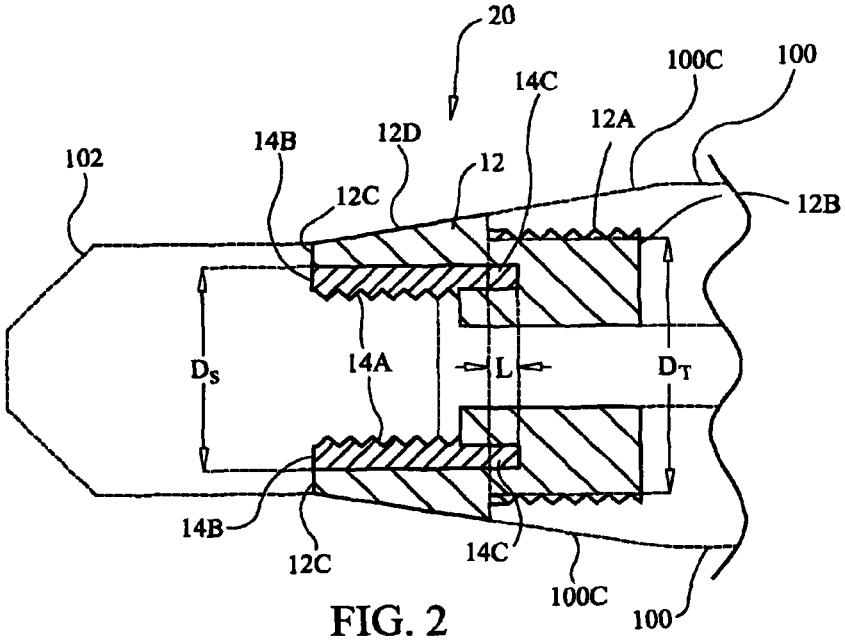
FIG. 2 is a cross-sectional view of a venting cap system in accordance with another embodiment of the present invention.

As mentioned above, the present invention is not limited by the configuration of the warhead and is not limited by the means of coupling/bonding the inner and outer sleeves. Accordingly and by way of an illustrative example, another embodiment of the present invention is shown in FIG. 2 and is referenced generally by numeral 20. Elements that are similar to those described in the previous embodiment are referred to by common reference numerals. In this embodiment, the illustrated end of warhead 100 is tapered as indicated at 100C. Outer sleeve 12 continues the taper on its external radial surface 12D forward of externally-threaded region 12A to blend into the external diameter of a fuze 102. Inner sleeve 14 is partially embedded in outer sleeve 12 at end 14C thereof to aid in the retention of inner sleeve 14. The partial embedding of inner sleeve 14 in outer sleeve 12 as illustrated could be formed, for example, by using insertion molding techniques.

The advantages of the present invention are numerous. The venting cap system will prevent a catastrophic cook-off event. At the same time, the venting cap system is mechanically strong enough to withstand rough ordnance-handling conditions.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed is:

1. A venting cap system, comprising:

a first open-ended sleeve of a first material for melting at a selected temperature, said first open-ended sleeve includes an internal region to commence at a first end thereof and defines a diameter $D_S$, said first open-ended sleeve includes an externally-threaded region to commence at a second end thereof, wherein said externally-threaded region defines a minor diameter $D_T$; and an inner sleeve of a second material being a solid at said selected temperature, wherein said inner sleeve is coaxially fitted in said first open-ended sleeve so that said first open-ended sleeve is bonded to said inner sleeve, wherein said inner sleeve includes a first end flush with said first end of said first open-ended sleeve, wherein said inner sleeve includes a portion, which axially overlaps at least part of said externally-threaded region by an amount L, wherein $L<(D_T^2-D_S^2)^{1/2}$, and wherein said first material and said second material include coefficients of linear expansion that are about equal.

2. The venting cap system as in claim 1, wherein said first material comprises a thermoplastic material.

3. The venting cap system as in claim 1, wherein said first material is selected from the group consisting of polycarbonate, compositions of polycarbonate and glass, nylon, and tetrafluoroethylene.

4. The venting cap system as in claim 1, wherein said second material comprises a metal.

5. The venting cap system as in claim 1, wherein said first material comprises a thermoplastic material and said second material comprises a metal.

6. The venting cap system as in claim 1, wherein said first material comprises a composition of polycarbonate and glass and said second material comprises aluminum.

7. The venting cap system as in claim 1, wherein said amount L comprises a maximum value satisfying $L<(D_T-D_S^2)^{1/2}$.

8. The venting cap system as in claim 1, wherein said inner sleeve includes an internally-threaded region, which commences at said first end thereof.

9. The venting cap system as in claim 1, wherein at least a portion of external surfaces of said inner sleeve comprise knurled surfaces.

10. The venting cap system as in claim 1, wherein said first open-ended sleeve defines a tapered external region situated between said first end thereof and said externally-threaded region thereof.

11. A venting cap system, comprising:

a first open-ended sleeve of a thermoplastic material for melting at a selected temperature, said first open-ended sleeve includes an internal region commencing at a first end thereof and defines a diameter $D_S$, said first open-ended sleeve includes an externally-threaded region to commence at a second end thereof where said externally-threaded region defines a minor diameter $D_T$; and an inner sleeve of a metal being a solid at said selected temperature, wherein said inner sleeve is coaxially fitted said first open-ended sleeve so that said first-open-ended sleeve is bonded to said inner sleeve, wherein said inner sleeve includes a first end flush with said first end of said first open-ended sleeve, wherein said inner sleeve includes a portion axially, which overlaps at least part of said externally-threaded region by an amount L, wherein L is a maximum value satisfying $L<(D_T^2-D_S^2)^{1/2}$, and wherein said first material and said second material include coefficients of linear expansion that are about equal.

12. The venting cap system as in claim 11, wherein said thermoplastic material is selected from the group consisting of polycarbonate, compositions of polycarbonate and glass, nylon, and tetrafluoroethylene.

13. The venting cap system as in claim 11, wherein said thermoplastic material comprises a composition of polycarbonate and glass, and wherein said metal comprises aluminum.

14. The venting cap system as in claim 11, wherein said inner sleeve includes an internally-threaded region to commence at said first end thereof.

15. The venting cap system as in claim 11, wherein at least a portion of external surfaces of said inner sleeve comprise knurled surfaces.

16. The venting cap system as in claim 11, wherein said first open-ended sleeve defines a tapered external region between said first end thereof and said externally-threaded region thereof.

17. A venting cap system, comprising:

a first open-ended sleeve of a first material for melting at a selected temperature, said first open-ended sleeve includes an internal region to commence at a first end thereof and defines a diameter $D_S$, said first open-ended sleeve includes an externally-threaded region to commence at a second end thereof where said externally-threaded region defines a minor diameter $D_T$; and an inner sleeve of a second material being solid at said selected temperature, wherein said inner sleeve is coaxially fitted in said first open-ended sleeve with at least a portion of external surfaces of said inner sleeve being knurled for engagement with said first open-ended sleeve so that said first-open-ended sleeve is bonded to said inner sleeve, wherein said inner sleeve includes a first end flush with said first end of said first open-ended sleeve, wherein said inner sleeve includes an internally-threaded region to commence at said first end thereof, and wherein said inner sleeve includes a portion axially, which overlaps at least part of said externally-threaded region by an amount L, wherein $L<(D_T^2-D_S^2)^{1/2}$, and wherein said first material and said second material include coefficients of linear expansion that are about equal.

18. The venting cap system as in claim 17, wherein said first material comprises a thermoplastic material.

19. The venting cap system as in claim 17, wherein said first material is selected from the group consisting of polycarbonate, compositions of polycarbonate and glass, nylon, and tetrafluoroethylene.

20. The venting cap system as in claim 17, wherein said second material comprises a metal.

21. The venting cap system as in claim 17, wherein said first material comprises a thermoplastic material and wherein said second material comprises a metal.

22. The venting cap system as in claim 17, wherein said first material comprises a composition of polycarbonate and glass, and wherein said second material comprises aluminum.

23. The venting cap system as in claim 17, wherein said amount L comprises a maximum value to satisfy $$L<(D_T^2-D_S^2)^{1/2}.$$

24. The venting cap system as in claim 17, wherein said first open-ended sleeve defines a tapered external region situated between said first end thereof and said externally-threaded region thereof.

* * * * *